US006273390B1

(12) United States Patent
Meyer

(10) Patent No.: US 6,273,390 B1
(45) Date of Patent: Aug. 14, 2001

(54) POST HOLDER WITH UPRIGHT ADJUSTMENT

(75) Inventor: George Meyer, Alton (CA)

(73) Assignee: Royal Capital Stamping and Tooling Ltd., Etobicoke ( * ) Notice: Subject to any disclaimer, the term of this patent is extended or adjusted under 35 U.S.C. 154(b) by 0 days.

(21) Appl. No.: 09/421,255

(22) Filed: Oct. 20, 1999

(51) Int. Cl.[7] ..... A47B 97/00

(52) U.S. Cl. ..... 248/507; 248/507; 248/516; 248/530; 52/165

(58) Field of Search ..... 248/507, 516, 248/530, 522, 525, 545, 156, 288.51; 52/165, 155, 114, 113

(56) References Cited

U.S. PATENT DOCUMENTS 3,204,898 * 9/1965 Manning ..... 248/516
4,803,812 * 2/1989 Alexander, Sr. ..... 52/157
4,874,149 * 10/1989 Miceli ..... 248/530
5,280,871 * 1/1994 Chuang ..... 248/516
5,404,682 * 4/1995 West ..... 52/165
5,709,366 * 1/1998 Speece ..... 248/530
5,884,874 * 3/1999 Speece et al. ..... 248/516
5,927,677 * 7/1999 Speece et al. ..... 248/516

* cited by examiner

*Primary Examiner*—Anita M. King
*Assistant Examiner*—N. Morrison

(57) ABSTRACT

A post holder is formed by a lower spike portion and an upper bracket portion. The bracket portion is connected to the spike portion at an adjustable connection formed by a curved seat at the upper end of the spike portion and a curved base at the bottom end of the bracket portion. This adjustable connection enables different aligned positions of the bracket portion with the spike portion and an adjustable tightening member is provided to lock the bracket portion with the spike portion in any one of these different aligned positions.

1 Claim, 9 Drawing Sheets

CM
FP
FP
CM
15
3
1
15
1
3
F

POST HOLDER WITH UPRIGHT ADJUSTMENT

FIELD OF THE INVENTION

The present invention relates to a post holder of the type having a ground imbedding spike and a bracket for receiving the base of a post such as a fence post.

BACKGROUND OF THE INVENTION

Until recent years, most fence posts were held in position by first digging a large opening in the ground supporting surface for the fence post, filling the opening with concrete and before the concrete has an opportunity to set locating the bottom end of the fence post in the concrete.

The above process is very labor intensive and requires special working tools such as augers and the like for digging the ground out to receive the concrete base for the post.

In order to make it easier to embed the base of a fence post or any other type of ground support post, specifically designed post holders have been developed in the relatively recent past. For example, U.S. Pat. No. 4,874,149 shows a fence post holder having a bottom spike which is embedded into a ground supporting surface with a bracket fixed to the top of the spike for receiving the base of a fence post. This type of construction allows the spike to be simply hammered into the ground with the base of the fence post securing into the bracket above ground level.

A problem that occurs with respect to use of a construction as found in U.S. Pat. No. 4,874,149 is that the spike may not be driven in a perfectly vertical direction into the ground. As a result, the fence-post supported atop the spike extends upwardly at something other than a perfectly vertical position. This is quite noticeable, particularly for a relatively tall fence post, and adversely affects the overall construction of the fencing supported by the post.

In order to overcome the drawbacks noted immediately above, a fence post holder as disclosed in U.S. Pat. No. 5,884,874 has been developed. The fence post holder in the '874 patent once again comprises a lower spike portion and an upper bracket portion. However, unlike the earlier construction in the '149 patent, the bracket portion in the '874 patent is adjustable relative to the spike portion. This allows for upright positioning of the fence post even if the spike portion is not driven vertically into the ground.

In the '874 patent, the spike portion has a flat upper surface which receives a curved lower surface on the bracket portion. This connection is what allows adjustment of the bracket portion. However, because the two surfaces does not properly mate with one another, it is essentially impossible to secure them with one another in a manner which precludes undesirable deflection of the bracket portion when it is subjected to load applied to it by the fence post.

SUMMARY OF THE PRESENT INVENTION

The present invention provides a post holder which has an upper bracket portion adjustably secured to a lower spike portion at a connection which can be positively secured at different angled alignments of the bracket portion with the spike portion. These combinations of features arise as a result of a ball and socket type connection between the upper bracket portion and the lower spike portion of the post holder of the present invention. This connection further includes adjustable securing means for tightening the connection once the desired alignment of the two portions has been established.

BRIEF DESCRIPTION OF THE DRAWINGS

The above as well as other advantages and features of the present invention will be described in greater detail according to the preferred embodiments of the present invention which.

DETAILED DESCRIPTION ACCORDING TO THE PREFERRED EMBODIMENTS OF THE PRESENT INVENTION IN WHICH

Figure 1:
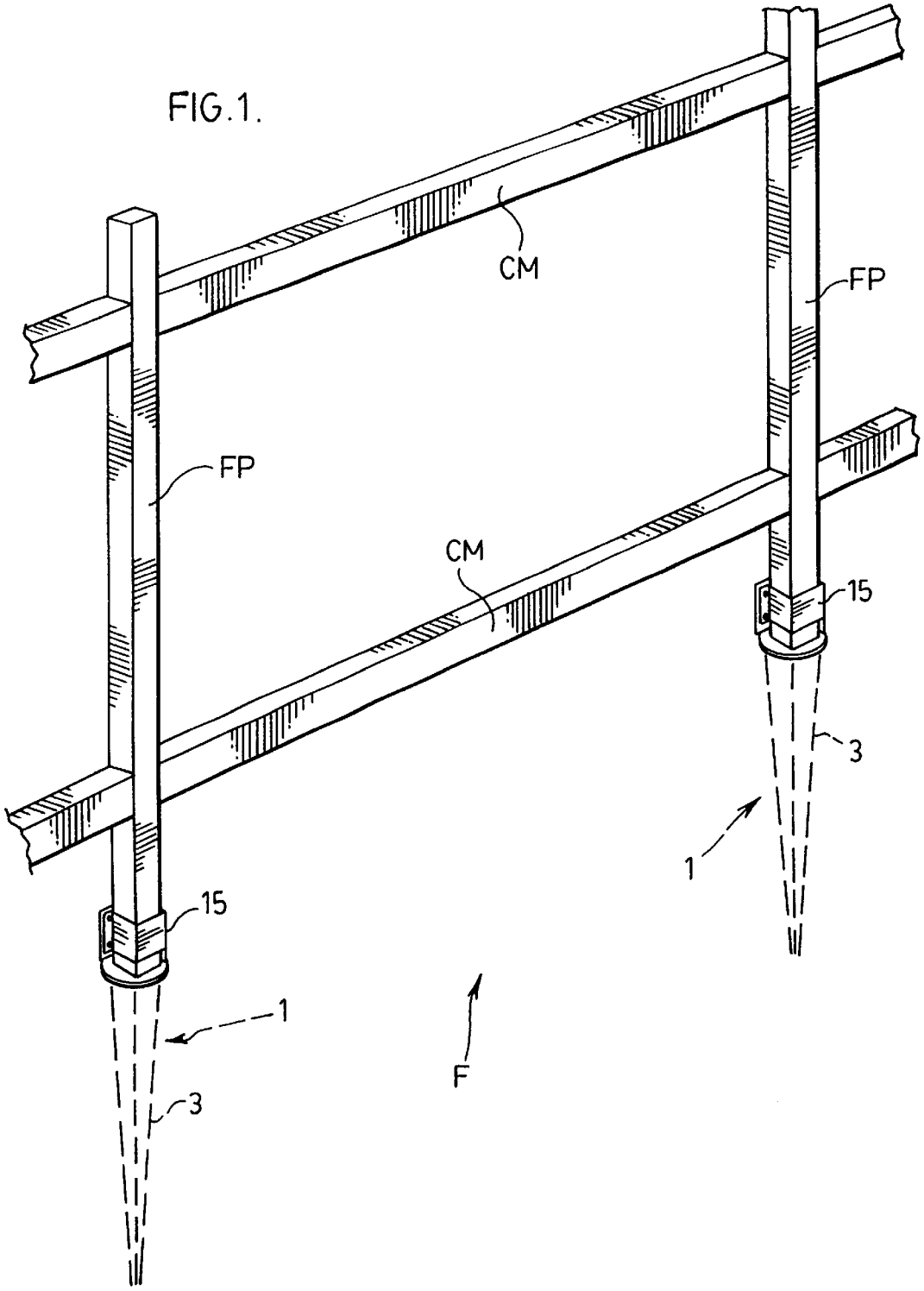
FIG. 1 is a perspective view of part of a fence including upright fence posts secured in position by fence post holders made in a ordnance with a preferred embodiment of the present invention.

FIG. 1 shows a section of a fence generally indicated at F. This fence is formed by a pair of cross members CM held in position by upright fence posts FP. The fence posts are secured to a ground supporting surface by means of fence post holders generally indicated at 1.

Figure 2:
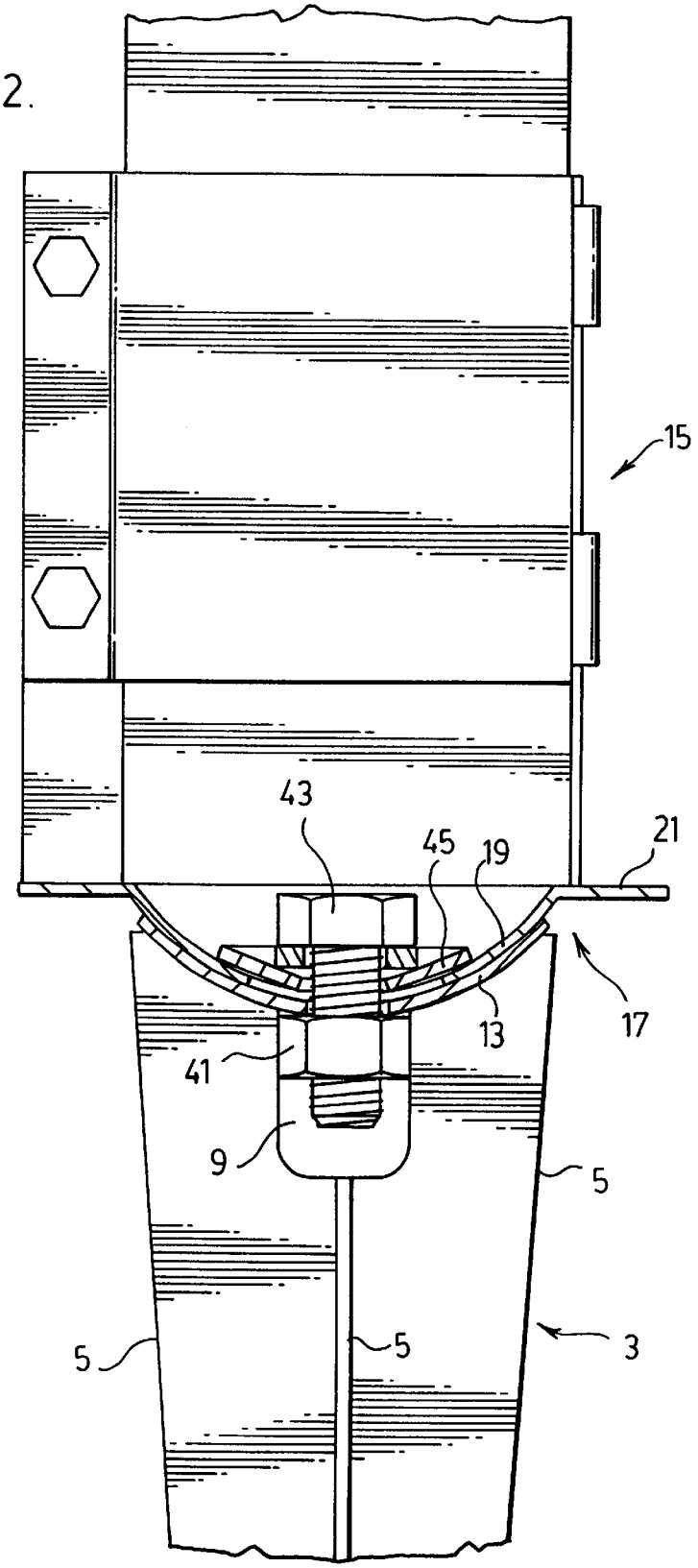
FIG. 2 is an enlarged sectional view through the connection region between the upper bracket portion and the lower spike portion of either one of the fence post holders seen in FIG. 1.
Figure 7:
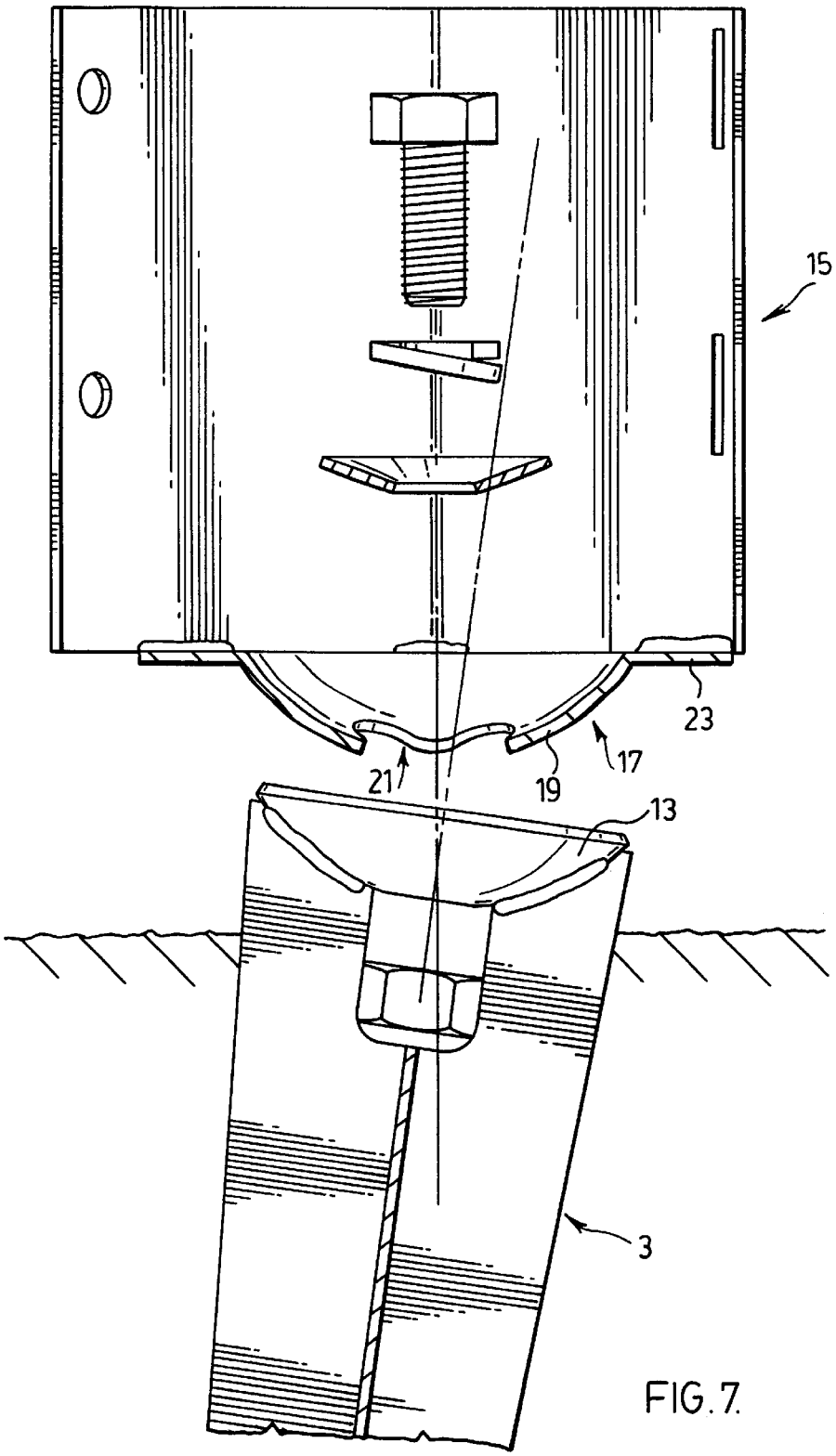
FIG. 7 is an exploded sectional view of the arrangement shown in FIG. 2.

The fence post holders 1, as better shown for example in FIGS. 2 and 7 of the drawings are formed by a lower spike portion generally indicated at 3 and an upper bracket portion generally indicated at 15. Spike portion 3 embeds into the ground as well shown in FIG. 7 and bracket portion 15 sits above ground level for receiving the bottom end of any one of the fence posts FP.

Figure 4:
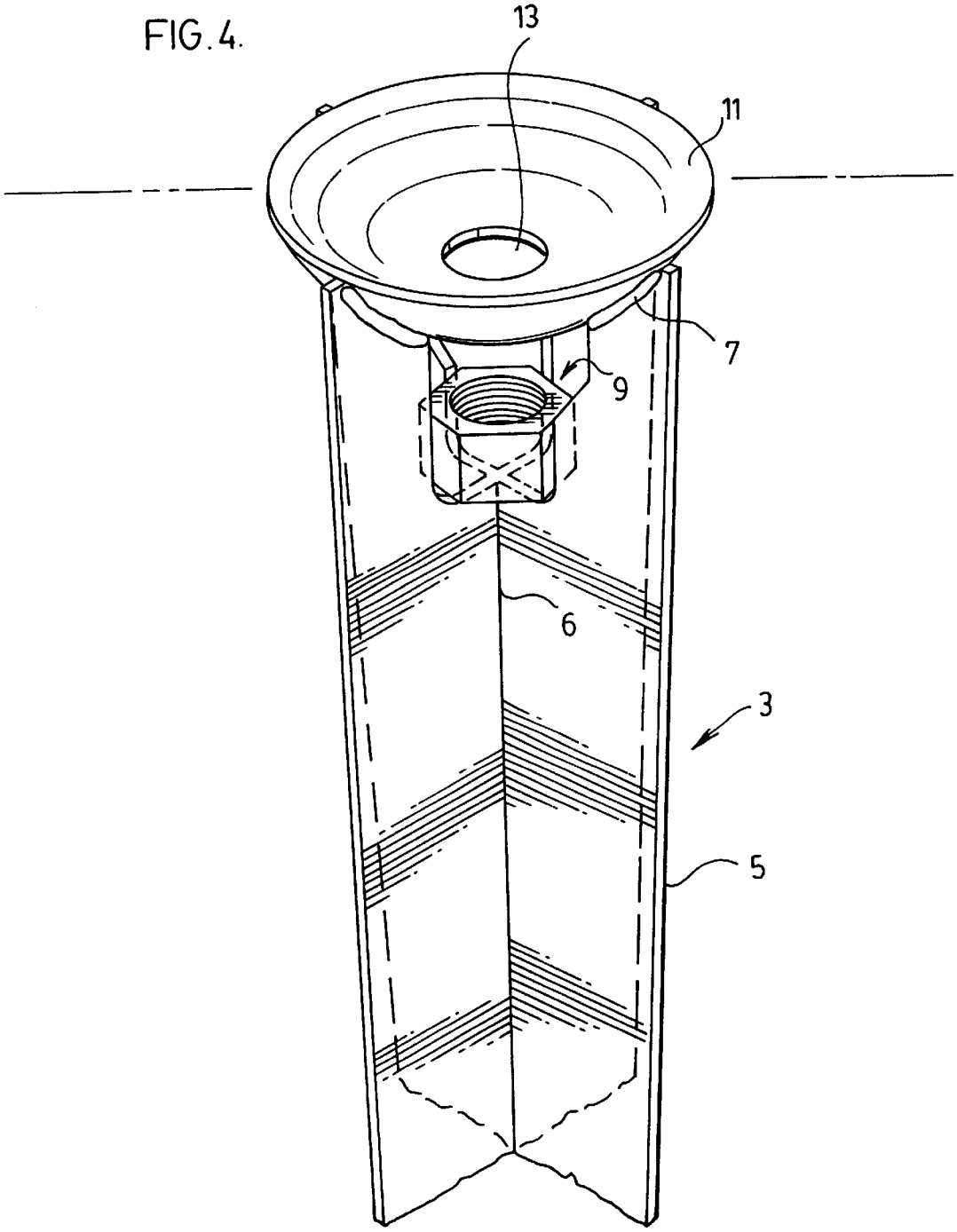
FIG. 4 is a top perspective view of the upper end of the lower spike portion of the fence post holder shown in FIG. 3.

Referring to FIG. 4 of the drawings, the spike portion 3 is formed by a plurality of tines or blades 5 which join centrally of the spike portion as indicated at 6 and diverge outwardly from their central connection.

Each of the blades 5 has a top surface 7 which curves downwardly inwardly towards a central recess generally indicated at 9. A dish 11 is secured to the curved upper ends of the different blades 5 around the spike. This dish includes a central opening 13 which aligns with the recess 9 directly below the dish.

Figure 3:
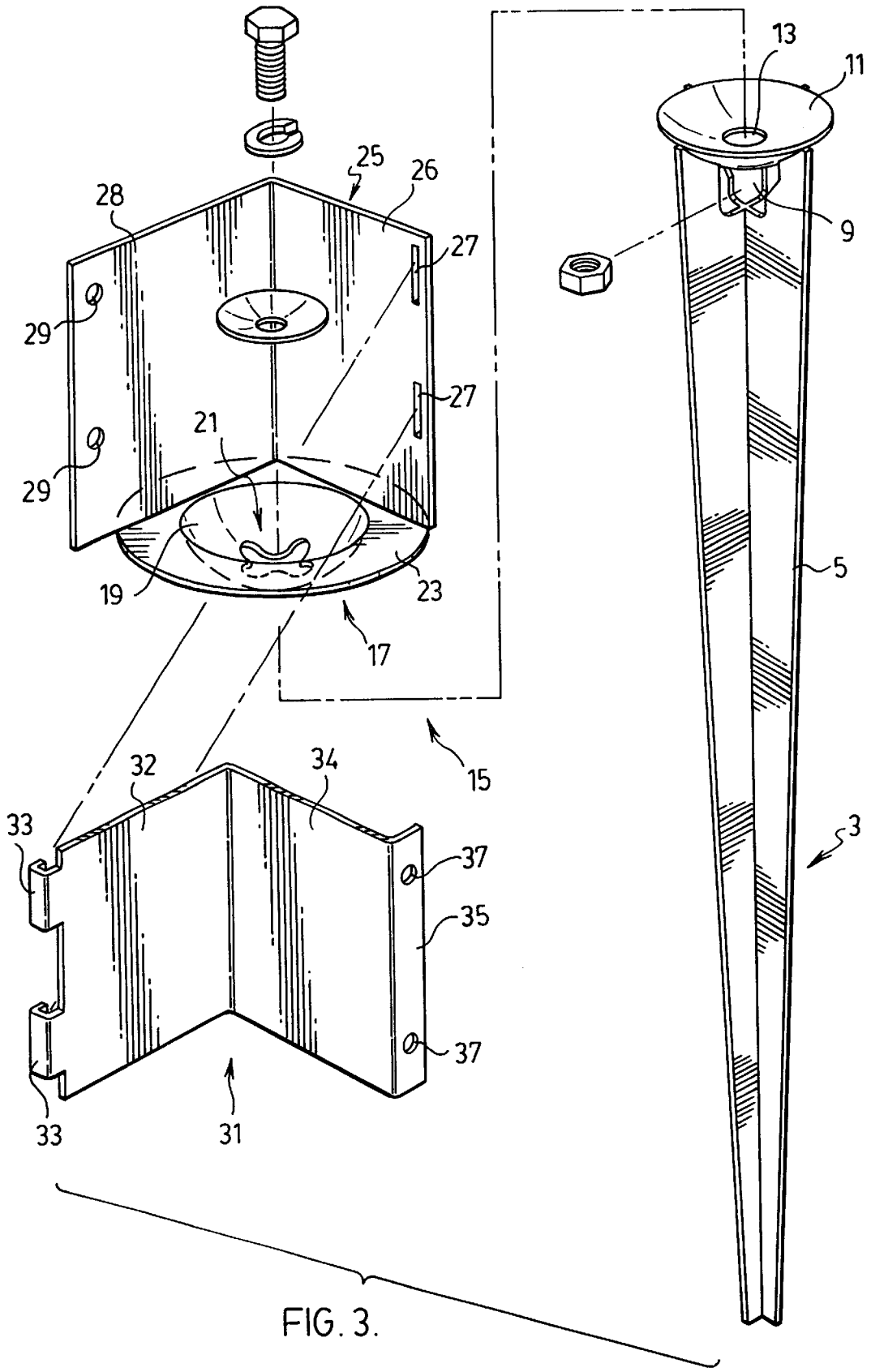
FIG. 3 is an enlarged exploded perspective view of either one of the fence post holders of FIG. 1.

FIG. 3 shows that the upper bracket portion 15 is formed by a base generally indicated at 17 and pair of bracket members 25 and 31 located above the base of the bracket portion.

Referring specifically to FIG. 7, it will be seen that the base 17 of the bracket portion comprises a dish 19 with an outwardly directed lip 23. Bracket member 25 is secured to the lip 23 of the dish.

Dish 19 includes a center opening 21 which has a peculiar somewhat star shaped opening 21, the purpose of which will be described later in detail.

Returning to FIG. 3, bracket member 25 is formed by a pair of panels 26 and 28 secured at right angles to one another. Panel 26 is provided with elongated slots 27 near its free end while the panel 28 is provided with a pair of openings 29 near its free end.

Bracket member 31 is formed by panels 32 and 34 at rights angles to one another. Panel 32 includes hook-like members 33 at its free end while panel 34 includes a small flange 35 at substantially right angles to the main body of the panel with this flange being provided with a pair of openings 37.

Figure 8:
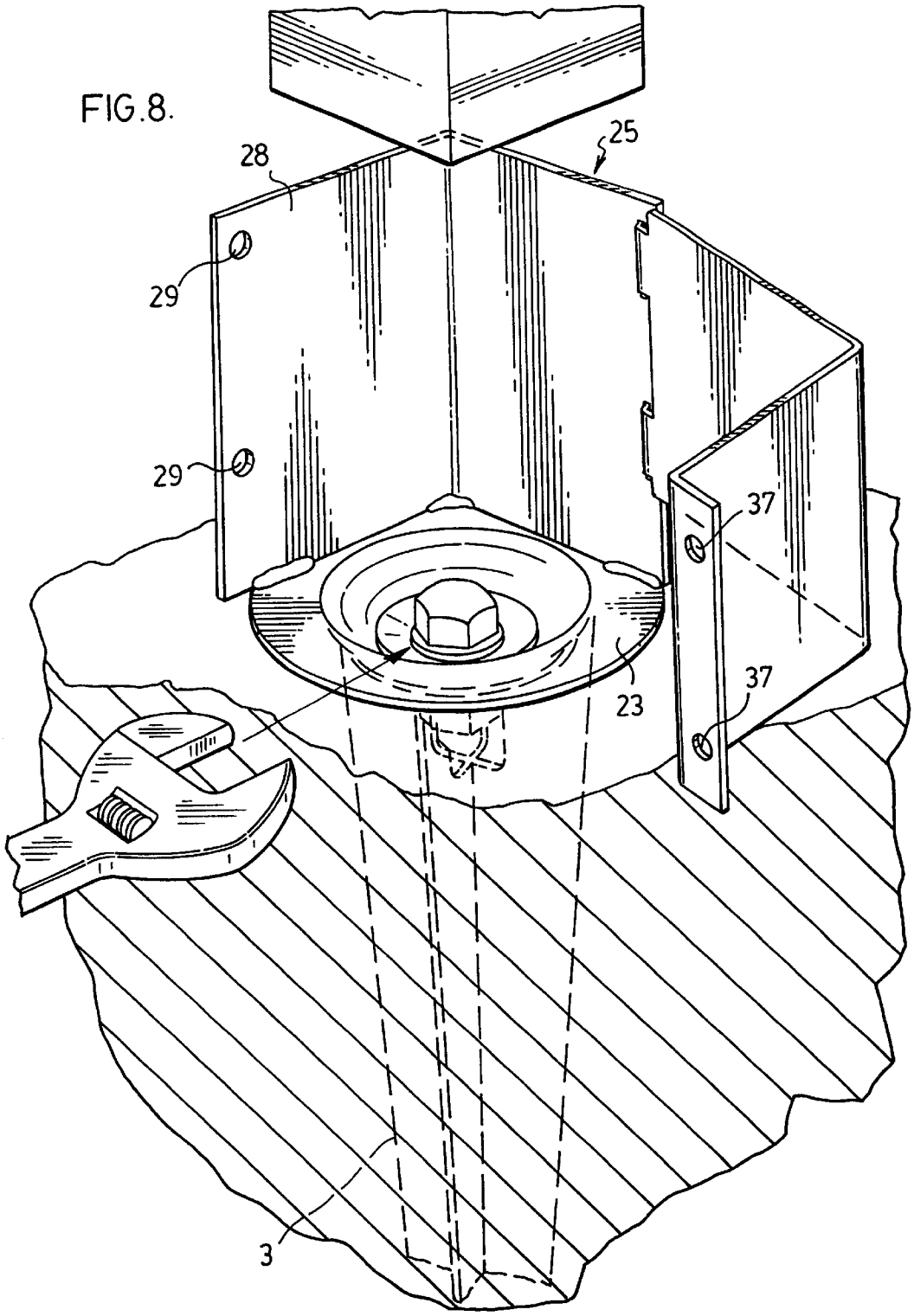
FIG. 8 is a perspective view of either one of the fence post holders of FIG. 1 embedded into the ground and ready to receive the base of a fence post.

Fastening means in the form of a nut and bolt combination is provided between the top bracket portion and the lower spike portion as best seen in FIG. 2 of the drawings. In particular, this nut and bolt combination comprises a nut 41 which locks against rotation in the recess 9 at the upper end of the spike portion and a bolt 43 which fits through a lock washer 45, the center opening 21 in the base of the bracket portion, the center opening 13 in the upper end of the spike portion and into the nut 41. FIG. 8 of the drawings shows that the head of the bolt 43 is exposed for tightening the bolt with the nut before the bottom end of the fence post is fitted into the bracket portion.

As noted above, nut 41 is locked against rotation in recess 9 because of the abutment of the shoulders on the nut with the interior faces of the blades 5 around the recess 9. Accordingly, the nut will not turn as bolt 43 is threaded into the nut by a tool for tightening the connection between the bracket portion and the spike portion as best seen in FIG. 8 of the drawings.

The key feature of the present invention resides in the connection of the lower end of the bracket portion to the upper end of the spike portion. A good demonstration of this is shown in FIG. 2 where it can be seen that the two dishes 13 and 19 have the same curvature with the height of dish 19 being greater than the height of dish 13. This places the lip 21 on dish 19 well above the outer edge of dish 13. Accordingly, the two dishes interfit in a ball and socket type manner with one another. The benefit of this interfitting will be described later in greater detail.

Figure 5:
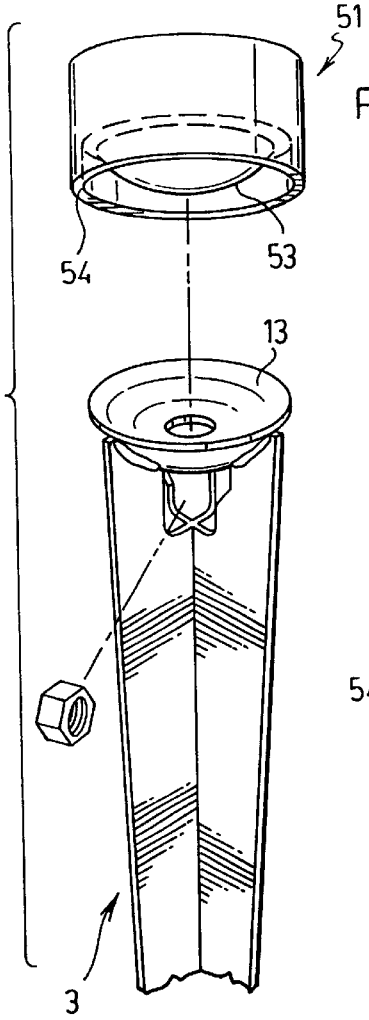
FIG. 5 is a perspective view of the spike portion shown in FIG. 4 additionally showing a tool helpful in embedding the spike portion.
Figure 6:
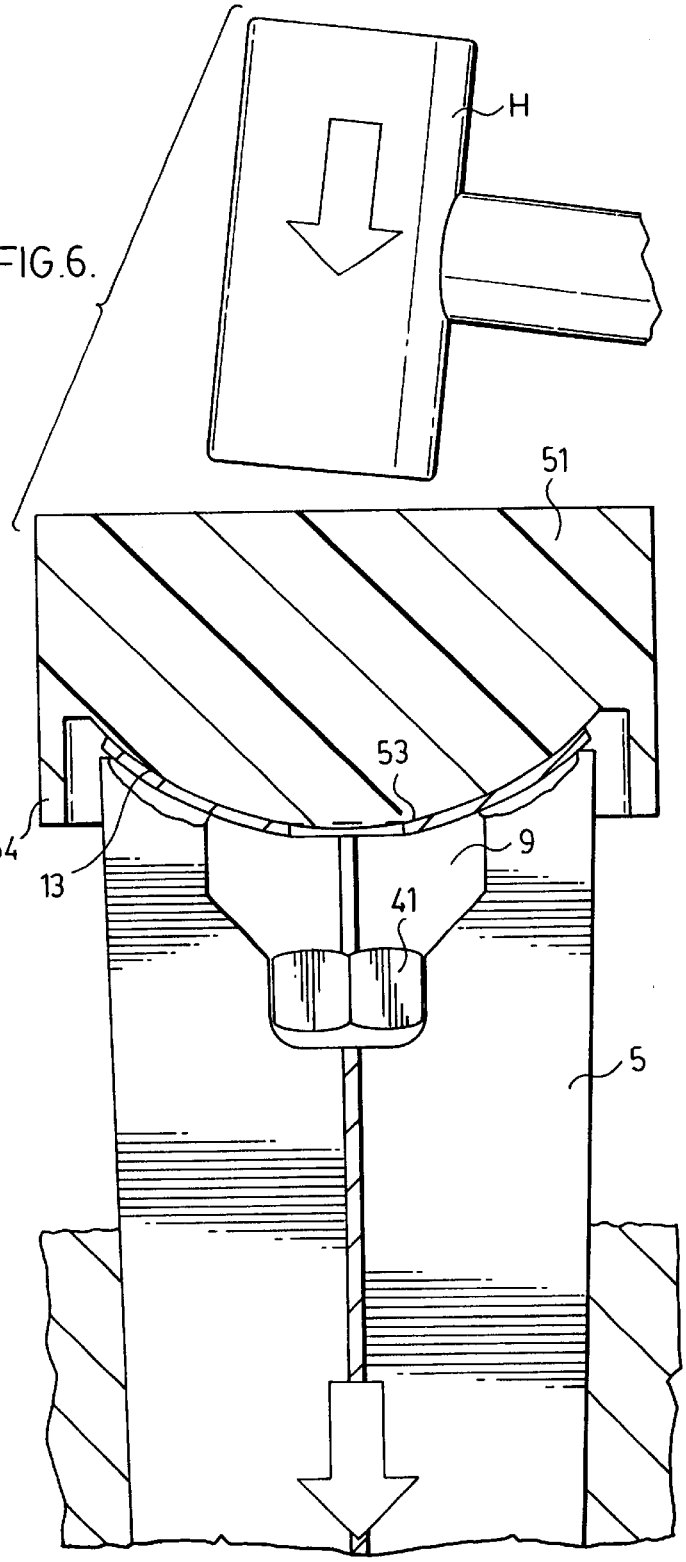
FIG. 6 is a side view showing the tool and spike portion of FIG. 5 as it is being embedded into a ground supporting surface.

FIG. 5 of the drawings shows at tool generally indicated at 51 which is used to help drive the lower spike portion 3 into the ground as better shown in FIG. 6 of the drawings. Tool 51 includes a convex base portion 53 surrounded by a downwardly projecting sidewall 54. The convex base 53 of the tool seats in dish 13 of the lower spike portion and is effectively locked there by means of the projecting sidewall portion 54 of the tool. The top surface of tool 51 is flat to receive impact from a large hammer H as shown in FIG. 6 for driving the spike into the ground. The force of the hammer is distributed evenly on the top of the spike because of the convex base 53 of the tool preventing point impact damage with dish 13 at the upper end of the spike.

After the spike has been driven into the ground, the tool 51 is simply lifted off of the upper end of the spike to receive the bracket portion of the fence post holder.

FIG. 7 of the drawings shows that spike portion 3 can easily be driven into the ground at something other than a vertical angle, i.e. the lower spike portion is driven downwardly off-set from vertical. This is something that may not be helped because of the slope on the ground surface, underground impediments such as rocks which may deflect the spike or simply through misjudgment by the person embedding the spike.

When the spike is embedded into the ground with its axis being angled from vertical then the fence post needs to be axially off-set from the spike in order to have the fence post sit perfectly vertically. This is achieved by angling the bracket portion relative to the spike portion such that the bracket itself is completely vertical. According to the present invention, such an adjustment is easily accomplished as a result of the above described ball and socket type connection, i.e. the dish within a dish connection of the bracket portion with the spike portion.

It is to be noted that because the upper dish 19 is of increased depth relative to the lower dish 13, the lip 23 on the upper dish is clear of the outer edge on the lower dish to enable a substantial amount of adjustment between the two dishes. Furthermore, the distinctive shaping of opening 21 in the base of the bracket allows the bracket to be swivelled around the bolt extending down to the spike.

A further key feature of the present invention results from the fact that the two dishes 13 and 19 have corresponding curvatures to one another. Accordingly, regardless of the amount of adjustment between the two dishes, there is always a substantial surface contact area between the two of them. This large surface contact area ensures a very large frictional engagement between the two dishes once the nut and bolt fastener has been tightly secured into position. This in turn ensures that the bracket portion will maintain its vertical orientation even under heavy load on the fence post.

After the spike has been driven into the ground and further after the bracket portion has been set to its vertical orientation, the base of the fence post is then fitted with the bracket portion. This is done by locating the base of the fence post which, in this case, has a rectangular configuration against the two panels 26 and 28 of the first bracket member 25 fixed to the base of the bracket portion. From here, bracket member 31 is hingedly secured to bracket member 25 by fitting the hooks 33 on the movable bracket member into the openings 27 of the fixed bracket member. This allows the movable bracket member 31 to complete the wrapping of the bottom of the fence post.

Figure 9:
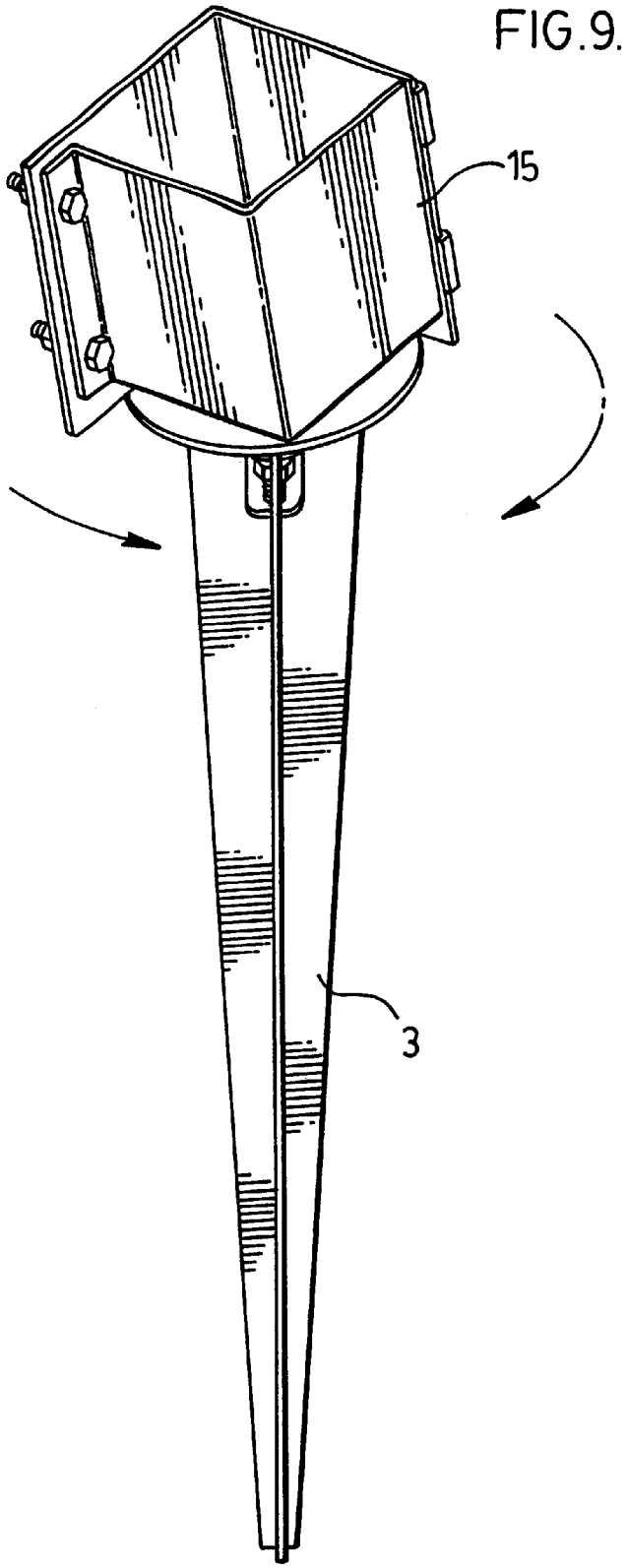
FIG. 9 is a top perspective view of either one of the fence post holder of FIG. 1.

FIG. 9 of the drawings shows that the flange portion 35 on the panel 34 of bracket 31 and more particularly, the openings 37 in that flange portion align with the openings 29 in panel 28 of the fixed bracket member 25. Nut and bolt fasteners are then secured through the aligned openings 29 and 37 to tighten the two bracket members 25 and 31 around the base of the fence post to positively secure it within the bracket portion of the fence post holder.

Figure 10:
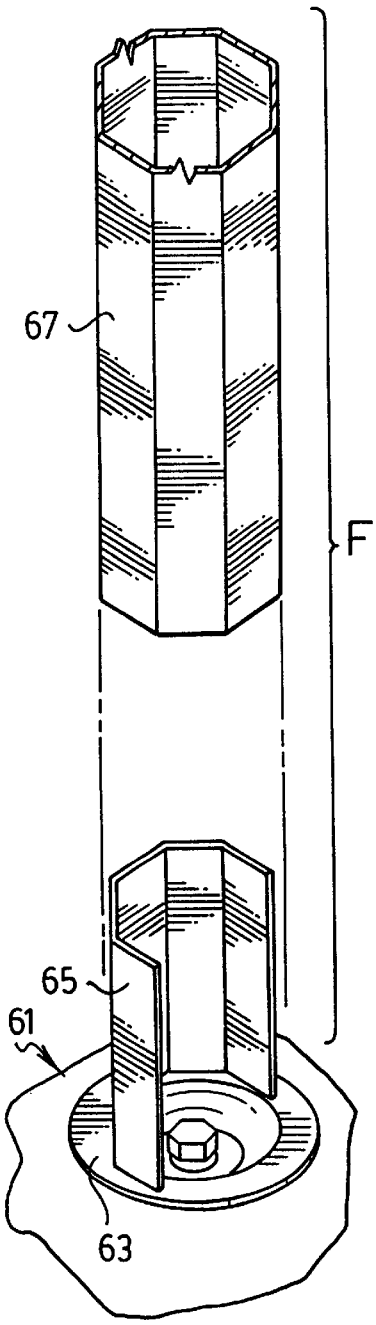
FIGS. 10 through 12 are perspective views showing modified bracket portions to be fitted to a spike portion according to further preferred embodiments of the present invention.

The adjustable clamping of the base of the fence post holder described immediately above is only one of many different set ups which can be used with the swivel connection of the bracket to the spike. For example, FIGS. 10 through 12 of the drawings show other methods to attach the bottom end of a fence post to an angle adjustable fence post holder according to further preferred embodiments of the present invention. Specifically in FIG. 10 a bracket portion generally indicated at 61 having a top bracket member 65 is secured to a dish 63. Dish 63 would once again adjustably fit with a lower spike portion. However, in this case, the upper bracket member 65 has a one piece construction to fit internally of a hollow multi-angled fence post 67 which would simply slide down over and lock onto bracket 65 as shown in FIG. 10 of the drawings. Fence post 67 would in this case typically have some type of a metallic construction.

Figure 11:
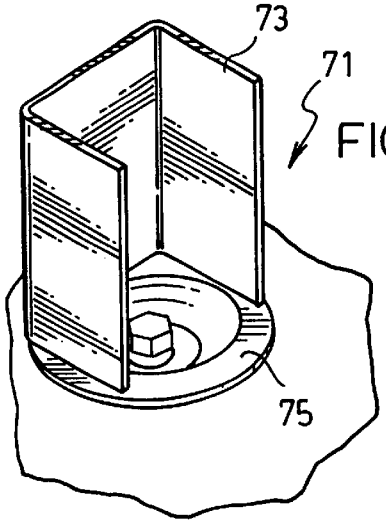

FIG. 11 shows a bracket portion generally indicated at 71 having a lower dish shaped base 75 and an upper bracket member 73. This bracket member would again fit internally of a hollow fence post which would have a rectangular configuration for fitting over bracket member 73.

Figure 12:
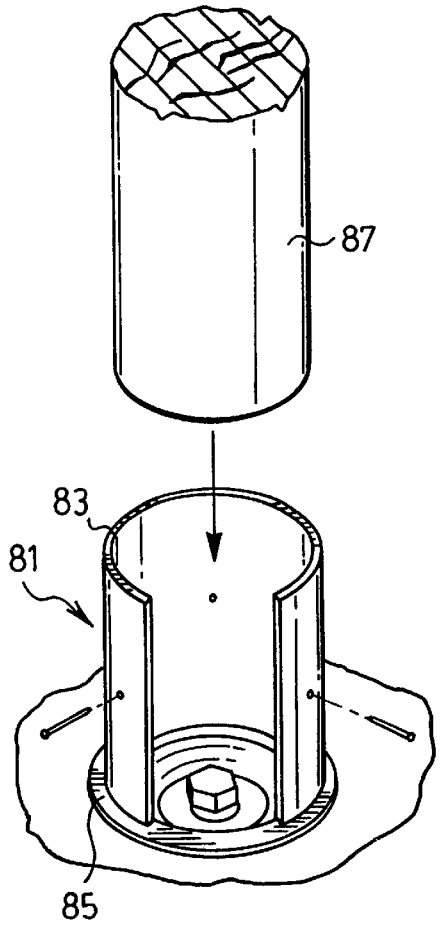

FIG. 12 of the drawings shows a bracket portion 81 having a lower dish shaped base 85 and an upper bracket member 83. In this case, bracket member 83 has a generally circular configuration for receiving the bottom end of a circular post 87. Post 87 would then be secured internally of bracket member 83 by means of screws or the like shown in FIG. 12.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A post holder comprising a lower spiked portion and an upper bracket portion, said lower spike portion having an upper end with a first curved dish having a peripheral edge therearound, said bracket portion having a base with a second curved dish, said second curved dish having an outwardly extending lip therearound which provides support for a fence post receiving bracket on said bracket portion, said first and said second dishes nesting with one another to provide a ball and socket type connection between said lower spike portion and said upper bracket portion, said peripheral lip around said second dish being elevated relative to said peripheral edge of said first dish to enable said second dish to slideably adjust on said first dish for different alignments of said bracket portion with said spike portion, and adjustable securing means for tightening of said ball and socket type connection; said spike portion comprising a plurality of spike blades joined centrally of said spike portion with one another, each blade having a curved top surface to which said first dish is secured, the curved top surfaces of the blades leading to a central recess at the upper end of the spike portion, each of said dishes having a central opening to said recess, and said adjustable securing means comprising a threaded nut which locks within said recess and a threaded bolt which fits through the central openings in said dishes to said nut.

* * * * *